United States Patent [19]

Novak

[11] Patent Number: 4,934,540

[45] Date of Patent: Jun. 19, 1990

[54] TOWEL HOLDING DEVICE

[76] Inventor: David M. Novak, 1894 Commercenter, Suite 201, San Bernardino, Calif. 92408

[21] Appl. No.: 334,797

[22] Filed: Mar. 31, 1989

Related U.S. Application Data

[63] Continuation of Ser. No. 119,968, Nov. 13, 1987, abandoned.

[51] Int. Cl.[5] ..... A47H 13/00

[52] U.S. Cl. ..... 211/124; 24/563; 248/74.2

[58] Field of Search ..... 211/124, 119.13, 119.18, 211/16, 89, 6; 248/316.7, 231.8, 230, 231.7, 231, 74.2; 24/462, 563; 297/191

[56] References Cited

U.S. PATENT DOCUMENTS

| | | | |
|---|---|---|---|
| 1,496,388 | 6/1924 | Stern | 248/231.8 |
| 2,448,456 | 8/1948 | Niskanen et al. | 248/544 X |
| 3,324,853 | 6/1967 | Czorny et al. | 248/74.2 X |
| 3,576,304 | 4/1971 | Gillemot | 248/74.2 |

*Primary Examiner*—Reinaldo P. Machado
*Assistant Examiner*—Sarah A. Lechok
*Attorney, Agent, or Firm*—Brown, Martin, Haller & McClain

[57] ABSTRACT

A tubular member having a lateral opening along one side forming a longitudinal opening that is expandable outwardly to be slipped over a support member on which a towel is draped, to resiliently grip the support member and hold the towel there between, and which tubular member may also have a flexible portion for allowing the tubular member to be bent and then fit onto a curved support.

3 Claims, 1 Drawing Sheet

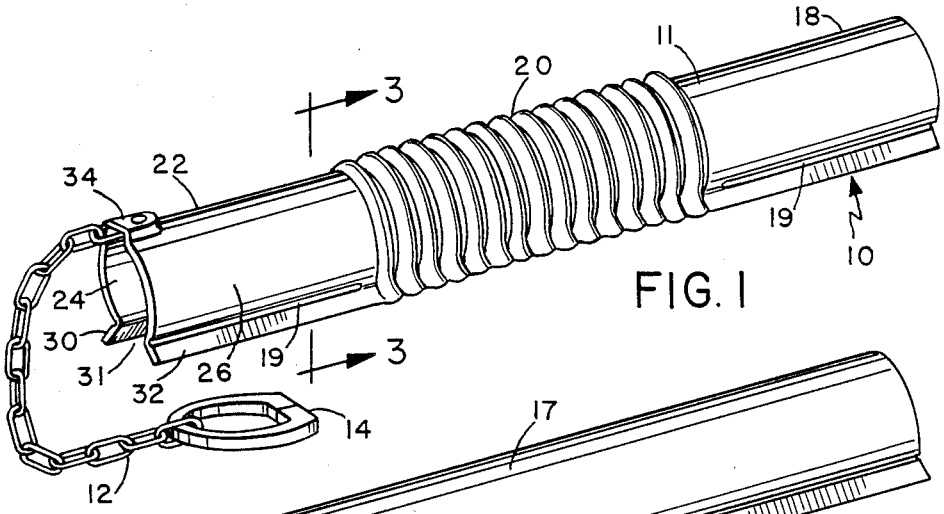
FIG. 1
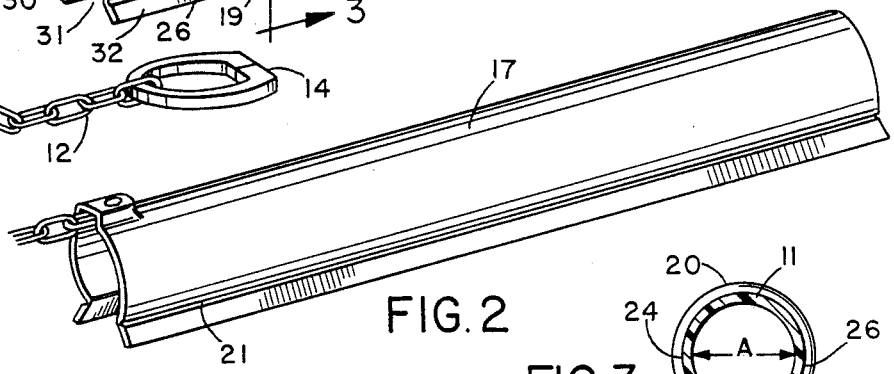
FIG. 2
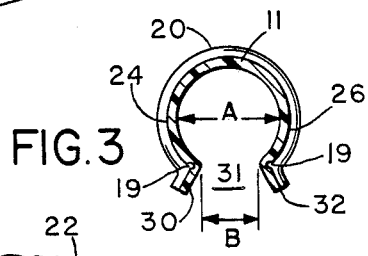
FIG. 3
FIG. 5
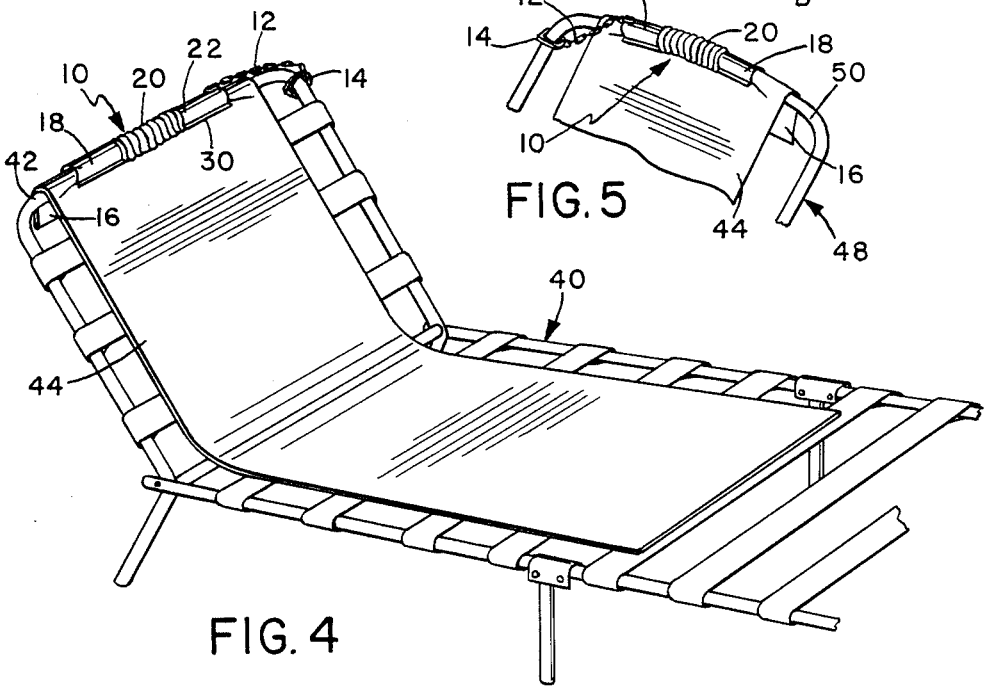
FIG. 4

TOWEL HOLDING DEVICE

This is a continuation of application Ser. No. 07/119,968, filed Nov. 13, 1987 now abandoned.

BACKGROUND OF THE INVENTION

Towels, beach towels and the like, are often draped over chairs and chaise lounges to either provide a more comfortable surface for sitting, or to just be a place for laying the towel. The chairs and chaise lounges are usually made of tubular material that either comprises the entire structure or provides a frame for supporting webbing or the like. The towels can either be positioned on the chaise lounges to provide a more comfortable support, or the towel may just be secured onto the chair to prevent it from being lost or taken by others.

Usually the tubular material used to construct outdoor lounges, chairs and the like, is fairly ridged and has diameters that fall within a given, narrow range.

It is therefore advantageous to provide a quick and easy used towel holding device that is capable of securing the towel in a draped condition over a chair or chaise lounge, with the towel being held against movement by the person setting or reclining on the lounge. The towel holding device thus secures the towel against movement through movement of the user, assures its general positioning on the lounge or chair, and further restricts someone taking the towel through an unwelcome appropriation.

SUMMARY OF THE INVENTION

In an embodiment of this invention, the towel holding device comprises a tubular member made of sheet material that is formed to provide a lateral opening that extends the longitudinal length of the tubular member. The opening is framed by curved sides having lips that are expanded outwardly to be slipped length-wise over the side of edge of a support. The support may be a tube section of a chair or chaise lounge, with the towel positioned or draped thereon. The sides when released bias inwardly to a spaced apart distance that is less then the diameter or thickness of the tubular member, thus resiliently gripping the tubular support and securing the towel draped thereover to a fixed position on the tubular support.

The towel in this secured position may then be spread over the lounge or chair and be held in that position, not withstanding the chair being used by a user that moves around a lot on the chair for any of many reasons extending from sitting in a steamroom to sunning themselves. The towel is prevented from being moved along the length of the seat, chair or lounge and is held against creeping movement on the lounge.

The longitudinal tubular member in its preferred form may be constructed of flexible plastic material that has a longitudinal rigidity against bending. In the preferred embodiment, the tubular member may have a flexible section positioned midway its length that allows the tubular member to be bent along its longitudinal length to slide over and be positioned on, and to resiliently grip a towel on, a curved tubular support. The tubular member also has a chain member secured at one end with the free end of the chain member having a locking device that may be slipped over and locked onto the support member to prevent easy and quick appropriation by others.

It is therefore an object of this invention to provide a new and improved towel holding device for securing a towel to a support such as portion of a chair or lounge.

BRIEF DESCRIPTION OF THE DRAWINGS

Other objects and many attending advantages will become more apparent upon reading the following detailed description and an examination of the drawings wherein:

FIG. 1 is a side end view in perspective of the towel holding device with the locking chain;

FIG. 2 is a perspective view of the Towel holding device with the locking chain and without the bendable section.

FIG. 3 is a cross-sectional view taken along lines 3—3 of FIG. 1;

FIG. 4 illustrates a typical chaise lounge with parts broken away with the towel holding device securing a towel in the position of use;

FIG. 5 illustrates the towel holding device in use on a curved support of a typical chair.

DESCRIPTION OF THE PREFERRED EMBODIMENTS

Referring now to the drawing, wherein like reference numerals will designate like parts, the towel holding device 10 is made of slightly, flexible plastic material that is formed in a tubular shape. The plastic material has sufficient thickness to be ridged and yet resiliently flexible. In the embodiment in FIG. 1, smooth portions 18 and 22 are resistant to side bending with the integral corrugated portion 20 allowing side bending of the tubular member along its longitudinal length. In the embodiment FIG. 1, the entire tubular member 17 does not have the corrugated, bendable portion 20, and thus is bendable only to a reduced degree.

The tubular member 11 has a lateral opening or slot 31 that extends the length of the member 11. The sides 24 and 26 of the opening 31 are curved inwardly to provide a spacing B there between that is smaller than diameter A of the tubular member 11. The edge portions of sides 24 and 26 have outwardly curved lips 30 and 32 forming a reverse curve that extend longitudinal length of the tubular member 11, including the corrugated portion 20 in FIG. 1.

The tubular member 11 has longitudinal recesses or slots 19 in the outer surface of sides 24 and 26 at the point of reverse curveture of the curved lips 30 and 31. These recesses provide for easier, outward bending of the respective lips 30 and 32 and sides 24 and 26, in expanding the sides 24 and 26 outwardly to fit on, for example, the tube 42 in FIG. 4.

The tubular member 17 in FIG. 2 also has the longitudinal recess 21 that extends the length of the member 17.

A connecting chain 12 is secured by a fastener 34 to one end of the tubular member 11, which chain member has a locking end 14 that locks the tubular member 11 to, for example, the tubular portion of chaise lounge 40 in FIG. 4 or 48 in FIG. 5.

In use, see FIG. 4, a towel 44 may be draped over a chaise lounge 40 with the end extending slightly over the top tubular portion 42 of the frame of the lounge 40. In this position, the upper end of the towel 16 could be expected to easily slide off the tubular portion 42. However, the towel holding device 10 is positioned in a manner of outwardly expanding the sides 24 and 26 and allowing the lip portions 30 and 32 to slide over the towel and snap back and fit around the tubular support 42, resiliently holding the end of 16 of the towel 44 in position.

Referring to FIG. 5, the towel is similarly secured in a fixed non-slideable position onto the top of the tubular frame 50 of the lounge or chair 48. The member 50 is curved both downwardly and outwardly, but this shape is matched by the towel holding device 10, as the corrugated portion 20 conforms the tubular member to the shape of the tubular support 50 to clamp the towel 18 in position.

Each of the towel holding devices 10 in FIGS. 4 and 5 are held in the clamped secured position by the lock 14 and attaching chain 12.

In operation, the towel holding device is slideably mounted on the top rung or a tube support of the frames of lounges 40 and/or 48 with the lips 30 and 32 sliding over the towel to hold the towel in the position as illustrated in FIGS. 4 and 5. When it is desired to remove the towel, the towel holder device 10 is removed by either pulling upwardly on the outwardly projected lips 30 and 32, thus sliding the tubular member 10 from the snapped position over the upper tube supports 42 and 50, or the lock device 14 may be released and the chain 12 used to pull the tubular member 11 or 17 from its towel securing position.

Having described my invention, I now claim:

1. A towel holding device for securing a towel onto a support, such as a portion of a chair or chaise lounge, comprising:

an elongate tubular member with a lateral opening having sides that extend longitudinally the length of the member;

the sides having edge portions spaced apart a distance less than the diameter of the tubular member, said edge portions for each of said sides having outwardly curved lip means for sliding over the towel in movement on and off the support;

said sides being resiliently biassed against outward movement, and in which said sides are expanded outwardly to fit over and grip the support with the towel held therebetween;

said tubular section having a flexible section which is corrugated for allowing said tubular member to be curved longitudinally for fitting onto a curved support.

2. A towel holding device as claimed in claim 1 in which:

said sides and said curved lip means form an outward reverse curve, and the outer surface of each of said reverse curves has a longitudinal indent at the junction between said edge portions and said lip means, said indent extending along at least part of the length of the tubular member from each end of the member.

3. A towel holding device as claimed in claim 1 in which:

a flexible chain is secured to one end of said tubular member and has a clamping device means at the other end of said chain for locking said tubular member to said support.

* * * * *